US005887999A

United States Patent [19]

Smith et al.

[11] Patent Number: 5,887,999

[45] Date of Patent: Mar. 30, 1999

[54] PAPER LOADING MECHANISM

[75] Inventors: Michael Smith; Edward Chupka, both of Ithaca; Barry Passer, Newfield; Alan H. Walker, Barton; Robert Delaney, Ithaca, all of N.Y.

[73] Assignee: Axiohm Ipb Inc., Ithaca, N.Y.

[21] Appl. No.: 944,165

[22] Filed: Oct. 6, 1997

[51] Int. Cl.[6] ..... B41J 11/70

[52] U.S. Cl. ..... 400/621; 400/613; 400/693; 400/599

[58] Field of Search ..... 400/586, 587, 400/589, 593, 594, 599, 613, 613.1, 621, 692, 693; 346/134, 136; 347/104, 215

[56] References Cited

U.S. PATENT DOCUMENTS

| | | | |
|---|---|---|---|
| 4,079,826 | 3/1978 | Shaw | 400/613 |
| 4,641,980 | 2/1987 | Matsumoto et al. | 400/613 |
| 4,979,838 | 12/1990 | Yokota et al. | 400/621 |
| 5,302,037 | 4/1994 | Schoendienst et al. | 400/586 |
| 5,746,527 | 5/1998 | Nebashi et al. | 400/621 |
| 5,791,796 | 8/1998 | Bustavsson et al. | 400/693 |

FOREIGN PATENT DOCUMENTS

| | | | |
|---|---|---|---|
| 59-106982 | 6/1984 | Japan | 400/621 |
| 4-166373 | 6/1992 | Japan | 400/692 |

*Primary Examiner*—Christopher A. Bennett
*Attorney, Agent, or Firm*—Salzman & Levy

[57] ABSTRACT

A new paper loading system is featured with a convenient drop-in paper loading and a full slip path in a receipt printer. The paper is dropped into a paper receiving bucket disposed in the central portion of the printer. The paper is fed from the bucket; and thereafter, a receipt is printed. Then, the paper is cut to the appropriate receipt length. A slip path is also provided for insertion of a single or multi-part form used for credit or check validation. The relative position of the slip path would normally interfere with the drop-in loading of the paper supply roll into the bucket. The system allows the fixed blade assembly to support a slip path upon a rear surface thereof. The slip path is substantially parallel or adjacent to the paper receipt path, which passes between assemblies supporting a fixed blade and a movable, rotary blade. The fixed blade unlatches and pivots away from the rotary blade, thus opening the printer and exposing the paper loading bucket for access thereto. The design eliminates the previous interference of the paper path with the slip path.

18 Claims, 10 Drawing Sheets

PAPER LOADING MECHANISM

FIELD OF THE INVENTION

The invention pertains to receipt printers and, more particularly, to a paper loading mechanism for a receipt printer that provides access to a paper receiving bucket in a first, open position, into which a roll of paper is dropped, and which allows for the printing and cutting of the paper in a second, closed position.

BACKGROUND OF THE INVENTION

In the past, loading paper into a receipt printer required the paper roll to be threaded through the receipt printing mechanism. The threading procedure was both time consuming and inconvenient. Changing paper at a checkout counter of a retail establishment caused undesirable delays. Several years ago, Axiohm Corporation of Ithaca, N.Y., pioneered a new receipt printing system, wherein the printer opened up, similar to the operation of a clamshell. The supply roll of paper was then drop-loaded into a printing bucket disposed in a central portion of the printer. The system featured a rotary blade that cut a section of paper from the roll as it came into contact with a fixed blade.

The present invention features a new paper loading system that also incorporates the convenient, drop-in paper loading feature. The paper is dropped into a paper roll receiving bucket disposed in the central portion of the printer. The paper is fed from the bucket; and thereafter, a receipt is printed. Then, the paper is cut to the appropriate receipt length. A slip path is also provided for insertion of a single or multi-part form used for credit or check validation.

The relative position of the slip path would normally interfere with the drop-in loading of the supply roll into the bucket. This invention provides a support surface for the slip path on a rear portion of the fixed blade assembly. The slip path is adjacent to the receipt path. The loading of the supply roll of paper is accomplished by unlatching and pivoting the fixed blade assembly away from the rotary blade assembly, thus opening the printer like a clamshell. This provides access to the supply roll bucket, and eliminates the previous interference of the blades with the slip path.

The advantage of the invention resides in the ability of the system to provide a full slip path simultaneously with drop-in paper loading. As aforementioned, the fixed blade assembly of the receipt printer of this invention is mounted on a pivotal bracket. The bracket disconnects and pivots to separate the fixed blade from the rotary blade. An actuator arm forces the fixed blade to snap backwardly from the rotary blade, under the biasing of two laterally spaced, tension springs. The rotary blade is now free to swing open and allow access to the paper bucket.

The pivotal bracket carrying the fixed blade latches to the rotary blade bracket via a latch stud that drops into a latching detent in the rotary blade bracket. The actuating arm pivotally cams the latch stud out of the detent, thus separating the fixed blade from the rotary blade. The actuating arm causes the latching stud of the fixed blade bracket to rise up over a camming surface of the rotary blade bracket, separating the fixed and rotary blade assemblies. Upon closure of the fixed and rotary blade assemblies, the biasing of the lateral springs allows the stud to reseat itself within the latching detent.

During separation of the assembly, the fixed blade bracket separates temporarily from a cap that anchors the fixed blade to the printer housing. Upon relatching, the cap and fixed blade bracket come back together under the influence of the spring biasing.

SUMMARY OF THE INVENTION

The present invention features a new paper loading system that provides convenient, drop-in paper loading with a full slip path. The paper is dropped into a paper receiving bucket disposed in the central portion of the printer. The paper is fed from the bucket; and thereafter, a receipt is printed. Then, the paper is cut to the appropriate receipt length. A slip path is also provided for insertion of a single or multi-part form used for credit or check validation. The relative position of the slip path would normally interfere with the drop-in loading of the supply roll into the bucket. This invention allows the fixed blade assembly to support a slip path upon a rear surface thereof. The slip path is substantially parallel or adjacent to the paper receipt path, which passes between assemblies supporting a fixed blade and a movable, rotary blade. The fixed blade unlatches and pivots away from the rotary blade, thus opening the printer and exposing the paper loading bucket. This renders access to the supply roll bucket. The design eliminates the previous interference of the paper path with the slip path.

The fixed blade assembly comprises a pivotal bracket that latches to the rotary blade bracket via a latch stud that drops into a latching detent in the rotary blade bracket. An actuating arm pivotally cams a latch stud, supported by the fixed blade assembly, out of a detent in the rotary blade bracket. The actuating arm causes the latching stud of the fixed blade bracket to rise up over a camming surface of the rotary blade bracket. This causes the fixed blade to separate from the rotary blade. Upon closure of the fixed and rotary blade assemblies, the biasing of two lateral springs allows the stud to reseat itself within the latching detent.

During separation of the assembly, the fixed blade bracket separates temporarily from a cap that anchors the fixed blade to the printer housing. Upon relatching, the cap and fixed blade bracket come back together under the influence of the spring biasing.

It is an object of this invention to provide an improved receipt printer having drop-in paper loading.

It is another object of the invention to provide a receipt printer having drop-in paper loading in combination with a full slip path.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components shall bear the same designation throughout the figures.

DESCRIPTION OF THE PREFERRED EMBODIMENT

Generally speaking, the invention pertains to a receipt printer having a full slip path and a clamshell design for drop loading a supply roll of paper therein. The design features the slip path having an adjacent or substantially parallel path to that of the receipt. A surface of the slip path is carried on the back of the fixed blade assembly that pivotally separates from the rotary blade.

Figure 1:
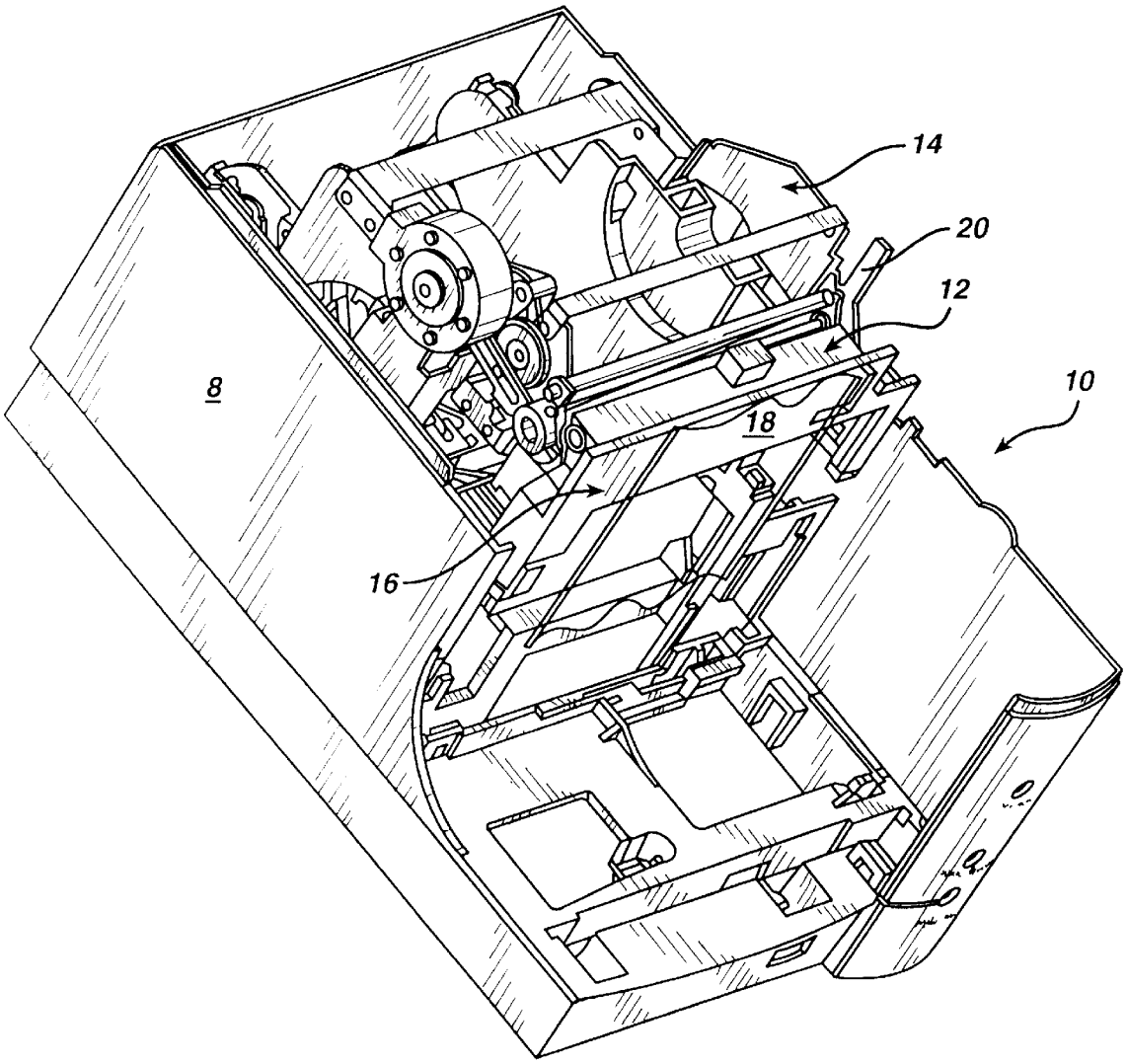
FIG. 1 illustrates a perspective view of the receipt printer of this invention.

Now referring to FIG. 1, a perspective view is shown of the receipt printer 10 of this invention. The receipt printer 10 has a housing 8 containing a fixed blade assembly 12, and a rotary blade assembly 14, shown here in a latched position. The back surface 16 supports or forms part of the slip path, and is illustrated with a slip 18 disposed on the back surface 16. An actuator arm 20 is shown on the side of the receipt printer 10. The actuator arm 20 is used to unlatch the fixed and rotary blade assemblies 12 and 14, respectively, from each other, as explained hereinafter with reference to FIGS. 4 and 5.

Figure 2:
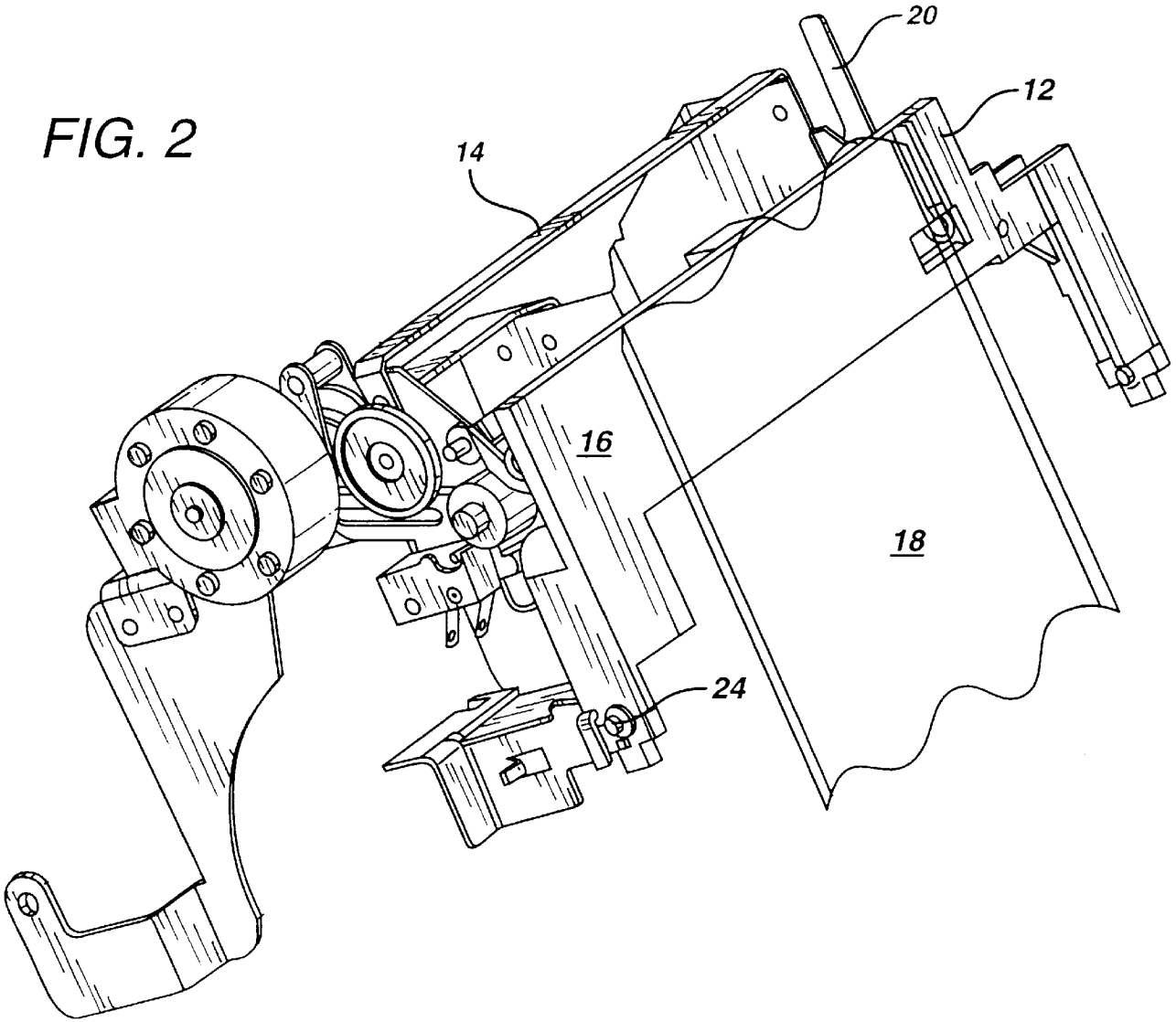
FIG. 2 depicts a front, enlarged perspective view of the fixed and rotary blade assemblies in their latched position, for the receipt printer shown in FIG. 1.

Referring to FIG. 2, an enlarged, left front perspective view of the assemblies 12 and 14 is illustrated. The back surface 16 of fixed blade assembly 12 supporting the slip 18 can be observed in better detail.

Figure 3:
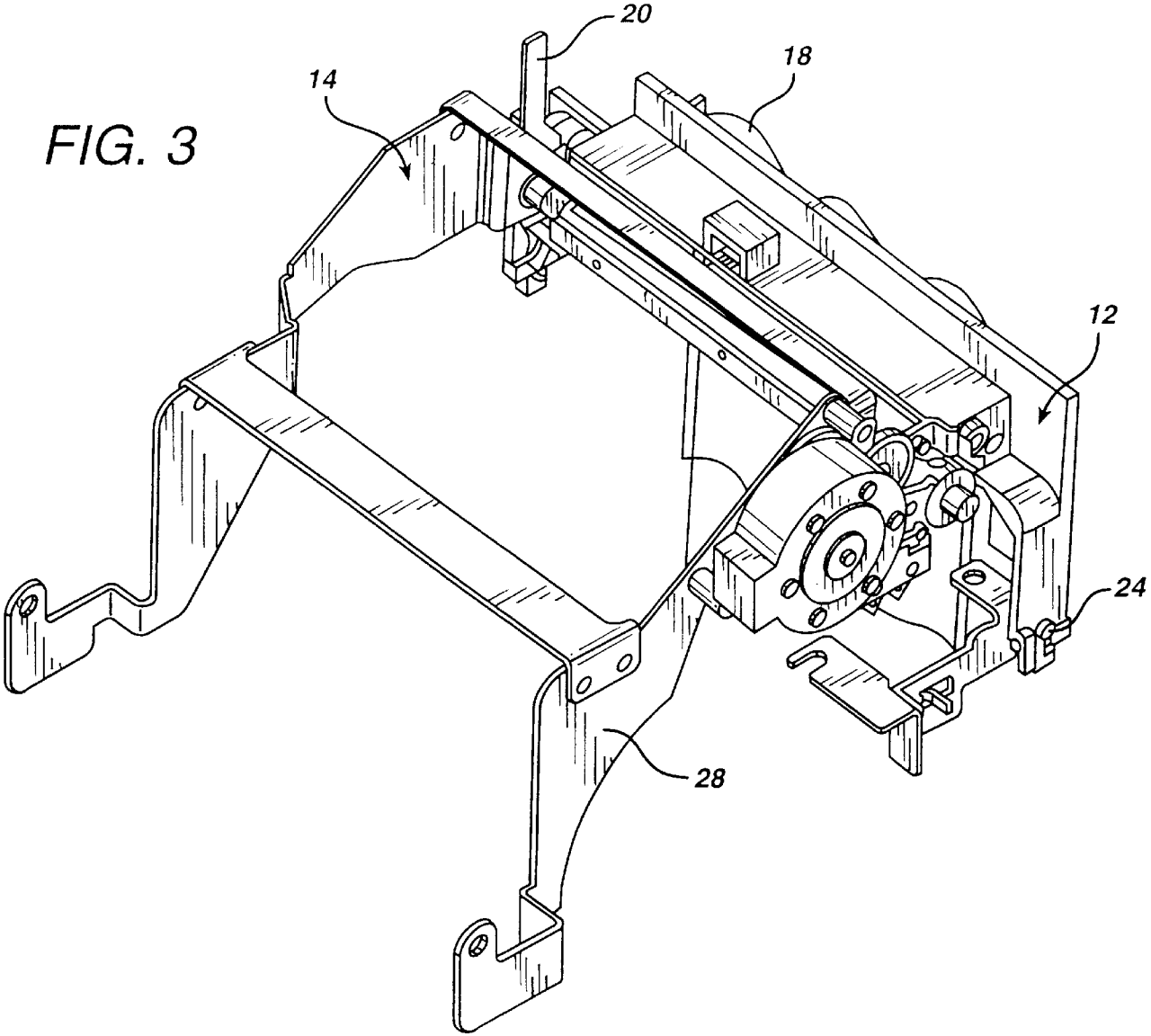
FIG. 3 illustrates a back, enlarged perspective view of the fixed and rotary blade assemblies in their latched position, for the receipt printer shown in FIG. 1.

Referring to FIG. 3, an enlarged, left rear perspective view is shown of assemblies 12 and 14. The slip 18 is now disposed behind the fixed blade assembly 12.

Figure 4:
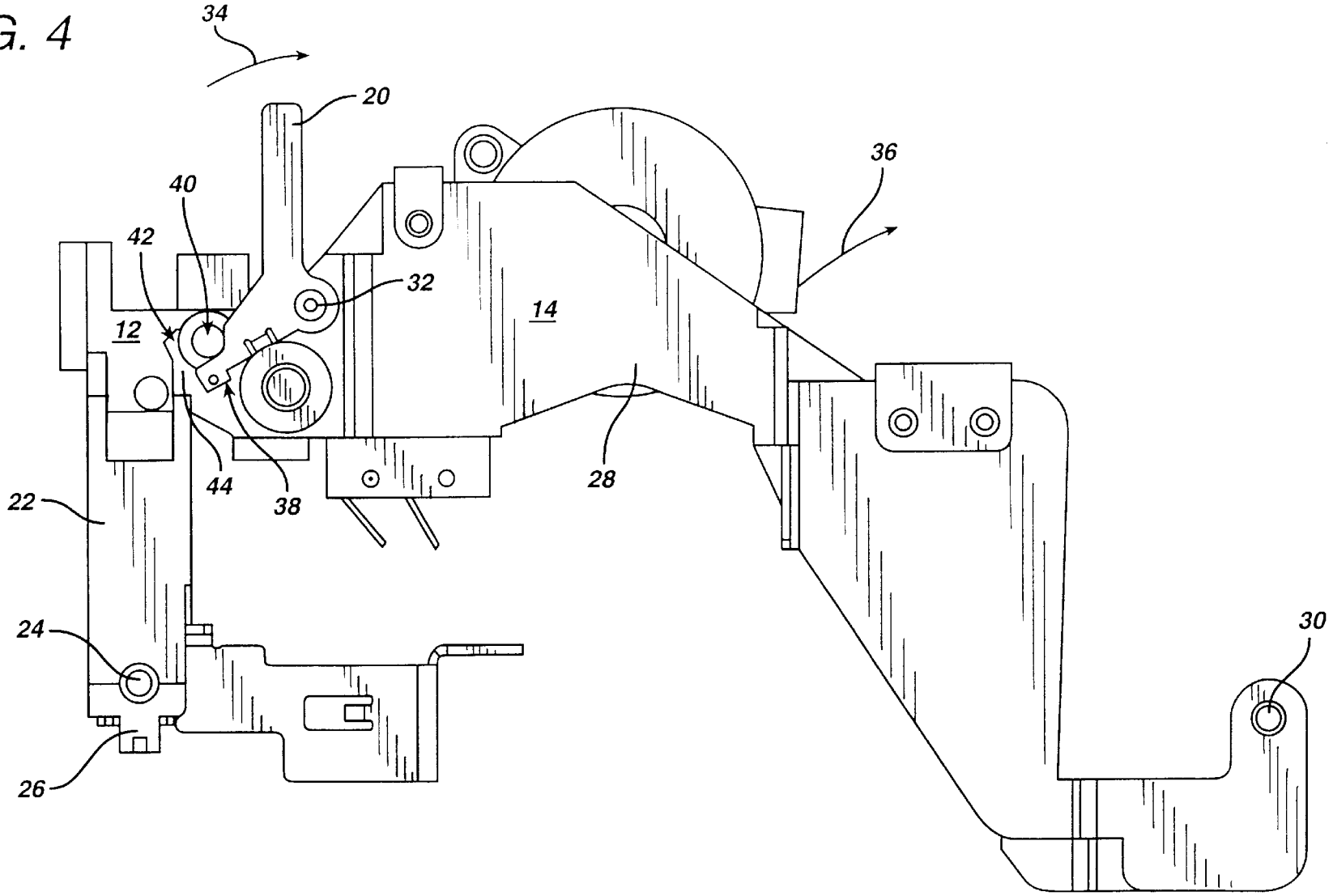
FIG. 4 shows a right side view of the latched assemblies depicted in FIGS. 2 and 3.

Referring to FIG. 4, a right side view of the latched assemblies 12 and 14 is illustrated. The fixed blade assembly 12 comprises a bracket 22 that pivots about a stud 24. A cap 26 anchors the bracket 22 to the printer housing 8. During the unlatching of the respective fixed and rotary blade assemblies 12 and 14, the bracket 22 temporarily separates from cap 26, as is better depicted and described with reference to FIGS. 5 and 8.

Figure 9:
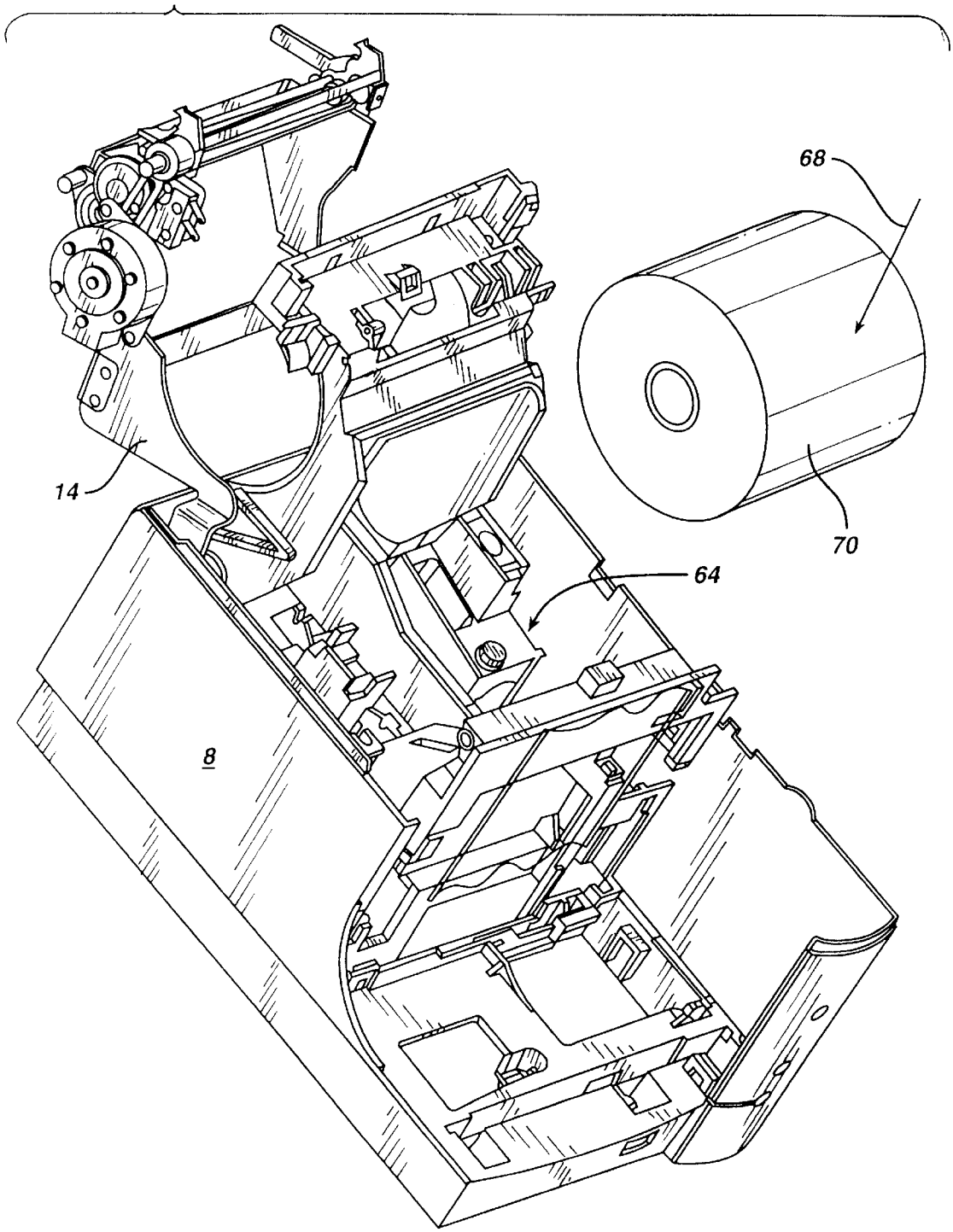
FIG. 9 illustrates a perspective, exploded view of the drop-in loading operation of the supply roll of paper into the receipt printer.

The rotary blade assembly 14 comprises a pivotal bracket 28 that pivots about a pivot point 30, and swings backwardly (arrow 36) when the two blade assemblies are unlatched and the receipt printer 10 is opened to receive a paper supply roll, as explained hereinafter with reference to FIGS. 9 and 10. The unlatching of these assemblies is performed by pushing backwardly (arrow 34) against the actuator arm 20, which is caused to pivot about pivot point 32. Pushing the actuator arm 20 causes the lower leg 38 of the pivot arm 20 to contact a pivot stud 40 and to force it out of the detent 42 disposed in the cradle leg 44 of bracket 22, as shown with reference to FIG. 5.

Figure 5:
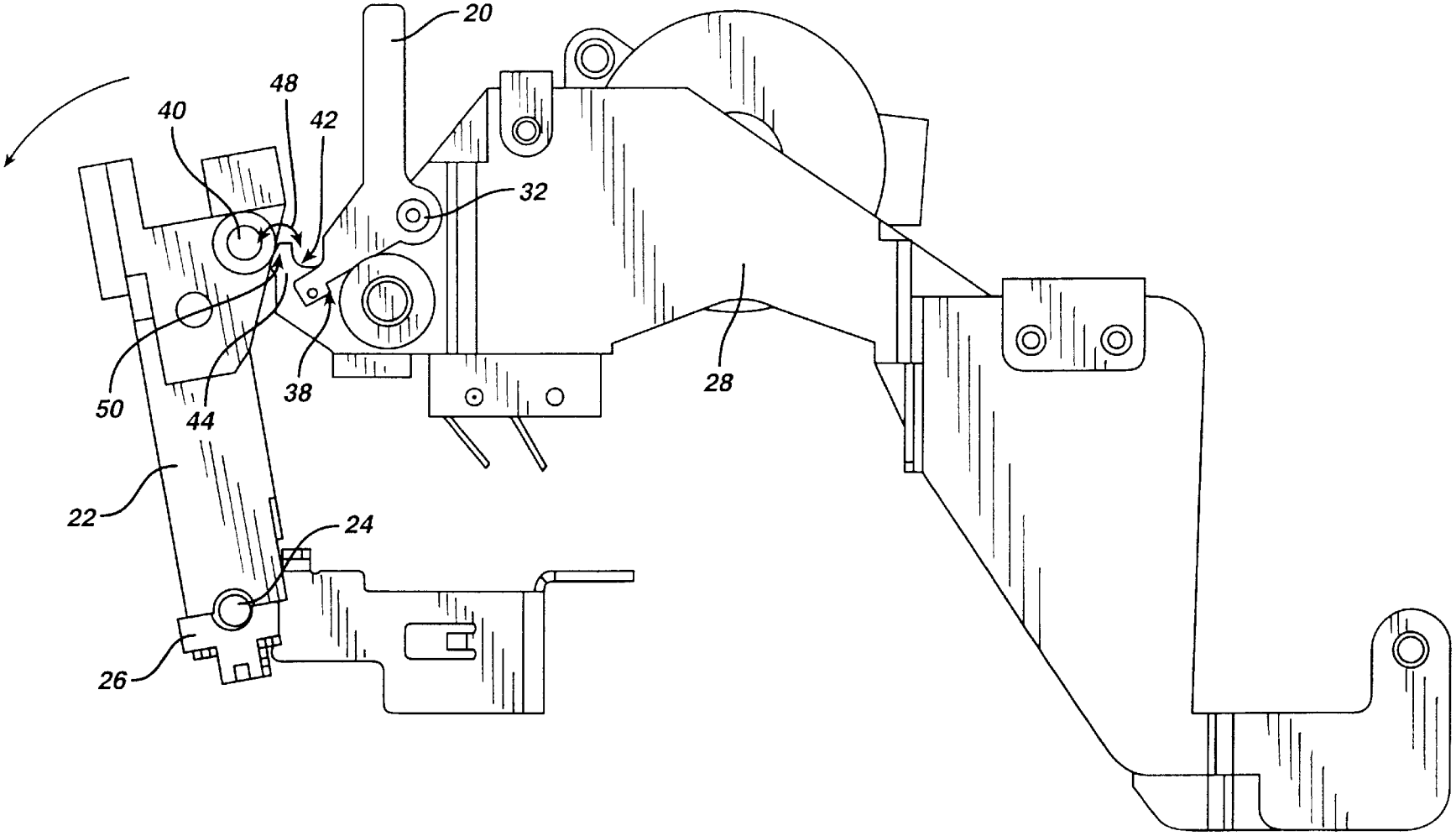
FIG. 5 depicts a right side view of the assemblies depicted in FIGS. 2 and 3, in the process of becoming unlatched from each other.

Referring now also to FIG. 5, the two blade assemblies 12 and 14 are shown in the unlatched position. It will be observed that the latching stud 40 is separated (arrows 48) from the detent 42 disposed in cradle leg 44 of bracket 28. As aforementioned, the latching stud 40 is forced from the detent 42 by actuator arm 20. In leaving the detent 42, the latching stud 40 is caused to roll over camming surface 50, disposed at the end of the cradle leg 44. When this happens, the fixed blade bracket 22 temporarily pulls away from the cap 26 and pivots about pivot stud 24. Cap 26 anchors the bracket 22 to housing 8, as aforementioned.

Upon relatching, the latching stud 40 rolls over the camming surface 50 in the opposite direction (arrows 48) and reseats itself into detent 42.

During latching and unlatching, the movement of the fixed blade bracket 22 is influenced by two laterally positioned tension springs 52, each disposed on the respective right and left sides of the printer 10. A representative spring 52 is shown in situ, in FIG. 8. The spring 52 influences the separation and the reforming of the bracket 22 about the cap 26.

Figure 8:
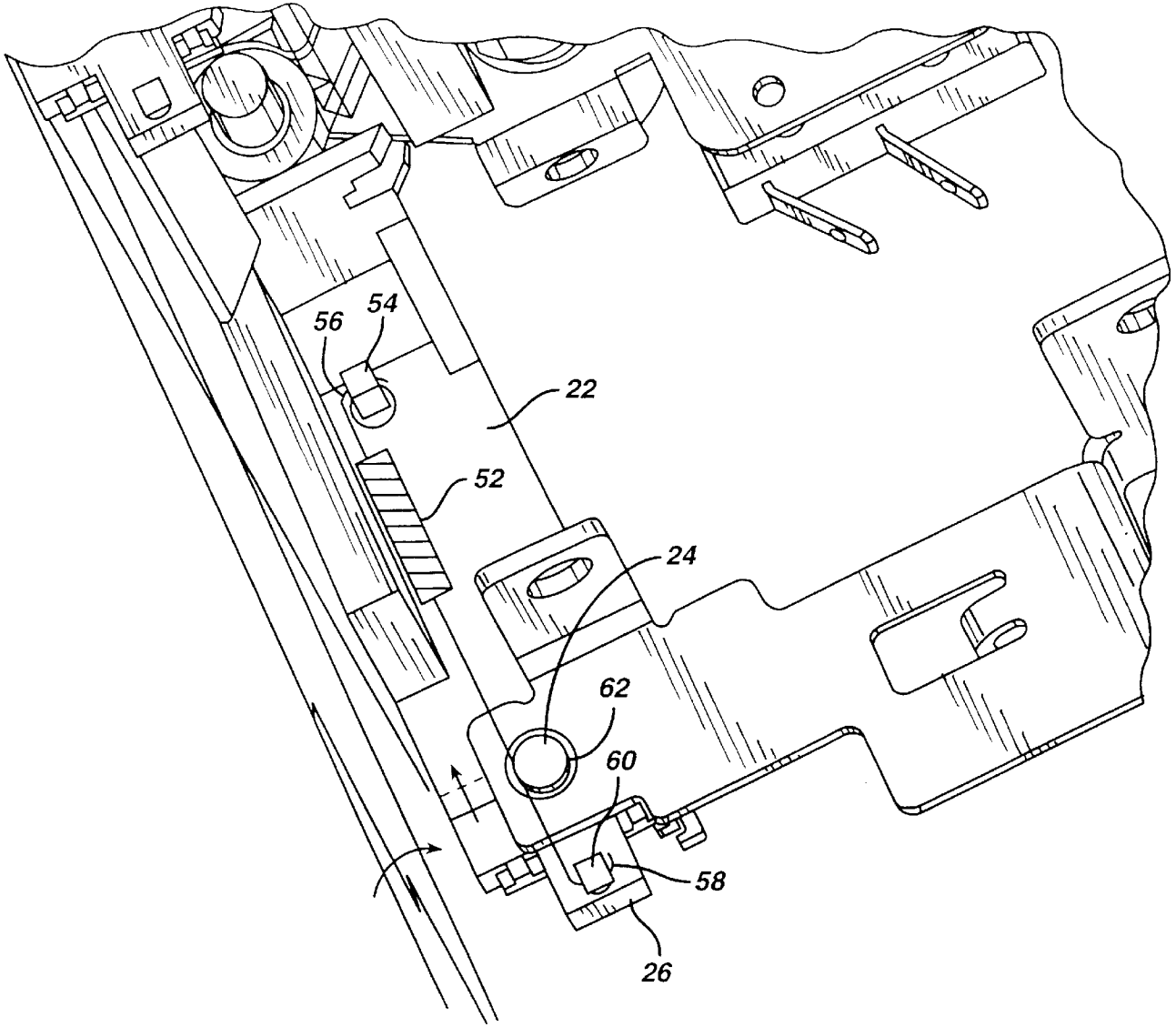
FIG. 8 shows an enlarged plan view of the spring holding the fixed blade bracket to the cap that anchors the fixed blade assembly to the housing of the receipt printer.

Referring to FIG. 8, there is illustrated an enlarged view of the assembly of the bracket 22 and cap 26. The spring 52 has a hook end 56 that engages with bracket 22 via a clip 54. Similarly, the distal end of spring 52 comprises hook end 58 that engages with cap 26 via a clip 60. The spring 52 encircles stud 24 with a loop 62 to provide support to the bracket 22 during separation thereof from cap 26.

Figure 6:
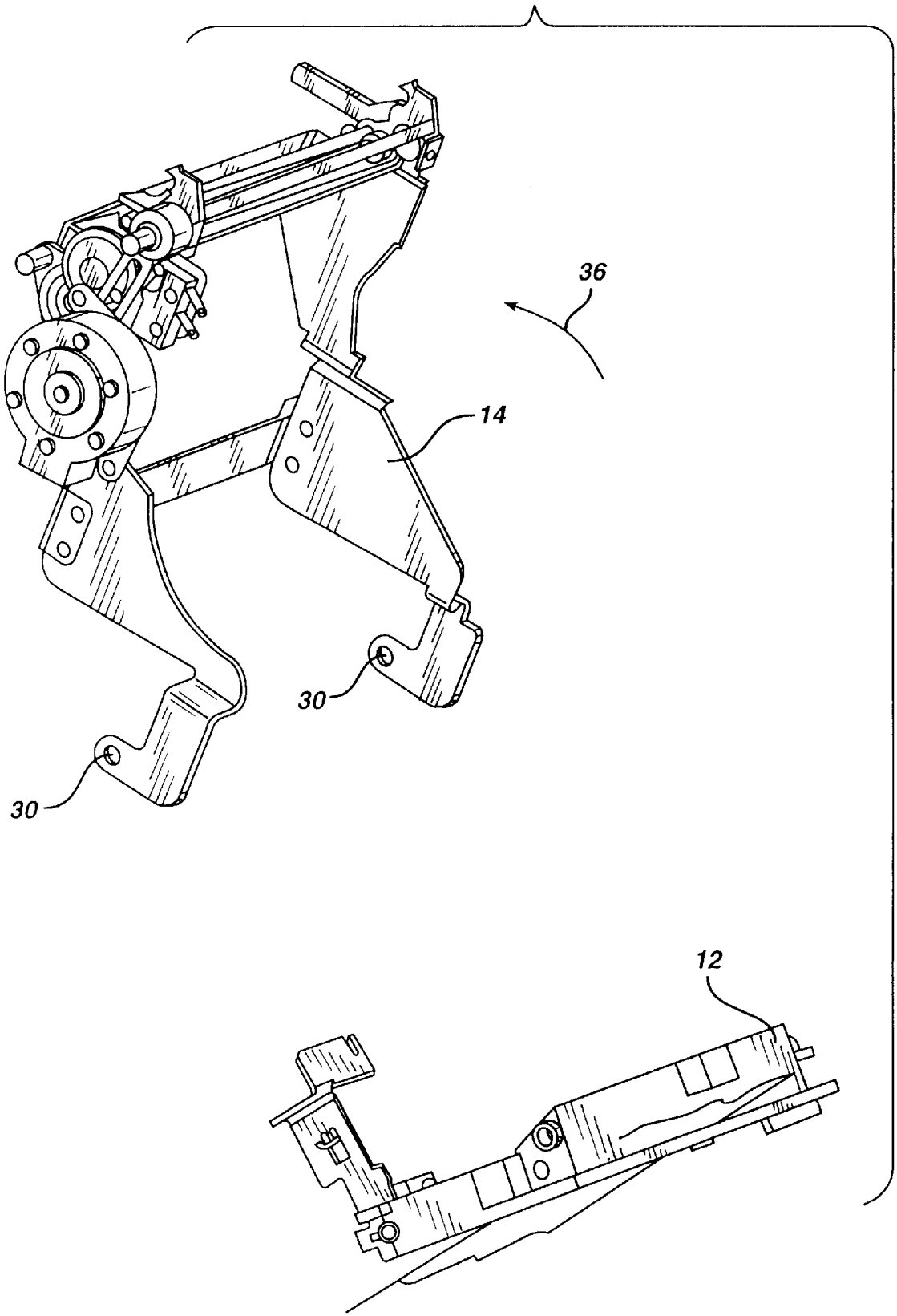
FIG. 6 illustrates an isometric view of the two assemblies shown in FIGS. 2 and 3, in the unlatched position.

During unlatching of the blade assemblies, the cap 26 stays in contact with the pivot stud 24, while the fixed blade bracket 22 separates therefrom. Upon relatching, the bracket 22 realigns itself with cap 26, and the two parts reunite under the influence of the spring biasing. The tension springs 52 also influence the rising and falling of the latching stud 40 with respect to the camming surface 50. The tension in the springs 52 assist the stud 40 to roll over the camming surface, as shown by arrows 48 (FIG. 5). In this manner, the fixed blade assembly 12 is secured when pivoting away from the rotary blade assembly 14. FIG. 6 shows the two blade assemblies in their unlatched and separated positions. After unlatching, the rotary blade assembly 14 is pushed backwardly (arrow 36) away from the fixed blade assembly 12. Referring again to FIG. 4, as aforementioned, the rotary blade assembly 14 pivots about pivot points 30.

Figure 7:
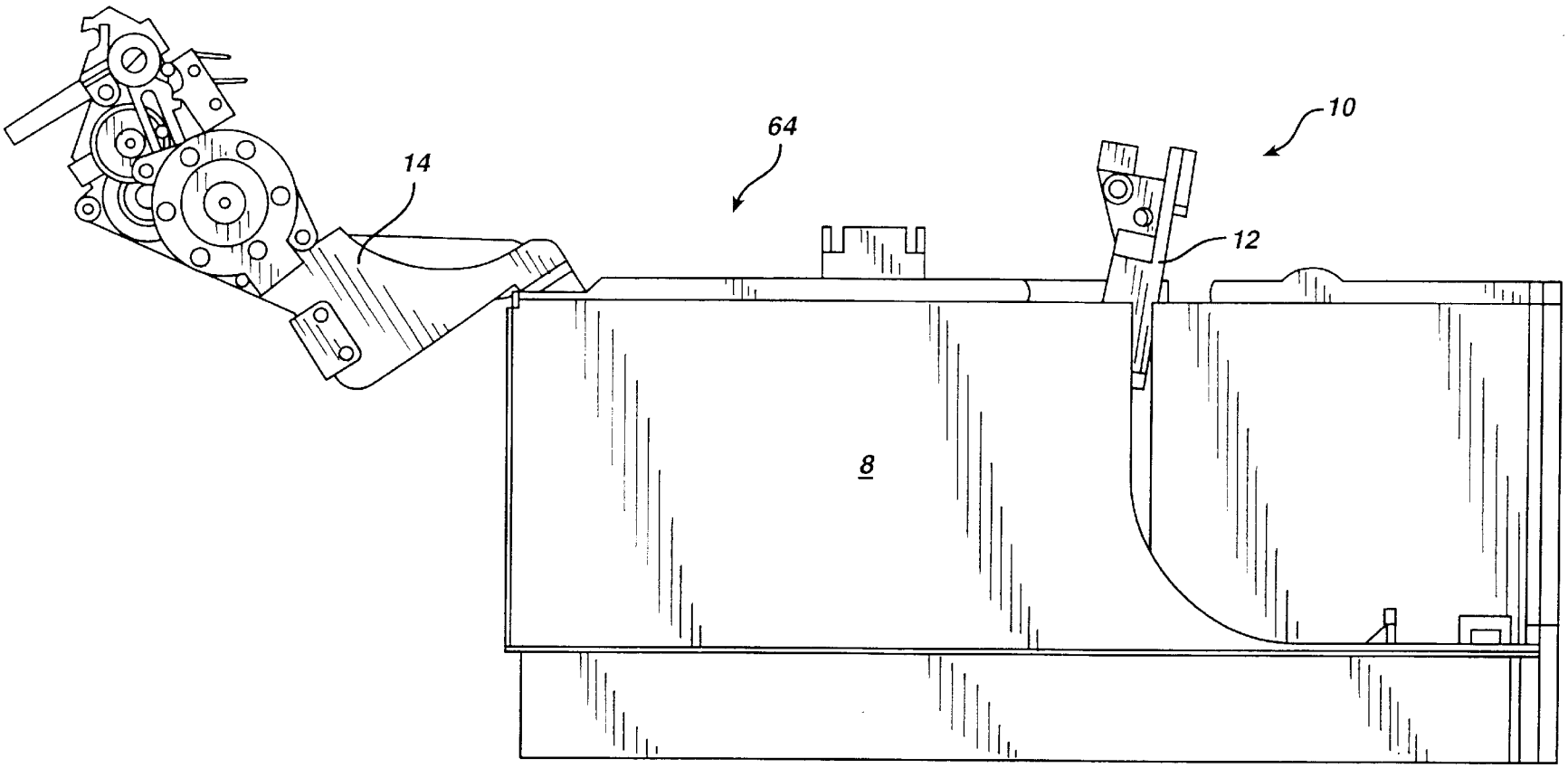
FIG. 7 depicts a side view of the receipt printer with the fixed and rotary assemblies in the unlatched position.

Referring to FIG. 7, the two respective blade assemblies 12 and 14 are shown in situ, with respect to the housing 8 of printer 10. In this unlatched and separated position, the assemblies 12 and 14 make possible the access to the supply bucket well 64, disposed in the mid-portion of housing 8.

The loading of the paper supply roll 70 is discussed with reference to FIG. 9. The supply roll 70 is shown being drop loaded (arrow 68) into the bucket 64.

Figure 10:
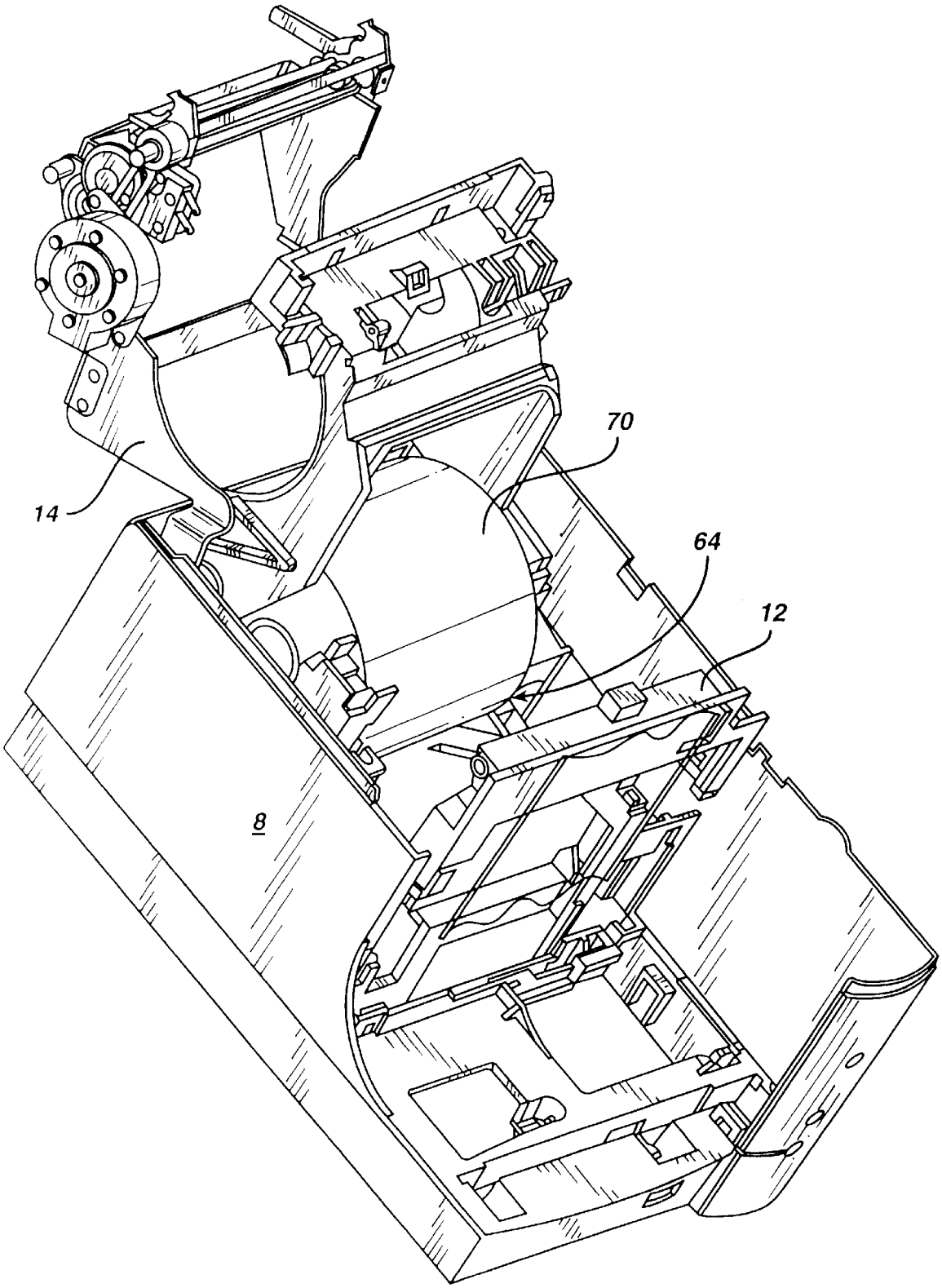
FIG. 10 depicts the receipt printer of FIG. 9, with the supply roll of paper dropped into the paper bucket.

Referring to FIG. 10, the supply roll 70 is depicted in its rest position within the bucket 64 of housing 8. After loading the bucket 64 with a fresh roll of paper, the printer 10 can then be closed and relatched by reversing the unlatching procedure depicted in FIGS. 1 through 4.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A paper loading system that features convenient drop-in paper loading with a full slip path in a receipt printer, comprising:

a housing supporting means defining a paper loading bucket;

a fixed blade assembly disposed within said housing and having a surface supporting a slip path;

a movable blade assembly disposed adjacent to said fixed blade assembly in a first, latched position;

means defining a slip path disposed within said housing and supported by said fixed blade assembly surface, said slip path being adjacent to a receipt path that runs between said fixed blade assembly and said movable blade assembly; and unlatching means carried by said housing for unlatching said fixed blade assembly from said movable blade assembly, whereby said movable blade assembly may be moved to a second, unlatched position providing access to said paper loading bucket, wherein said paper can be drop loaded into said paper loading bucket.

2. The paper loading system in accordance with claim 1, wherein said fixed blade assembly comprises a pivotal bracket having a latch stud disposed thereon, and said movable blade assembly comprises a movable blade bracket having a latching detent for receiving said latch stud, said fixed and movable blade assemblies being latched via the latch stud that drops into said latching detent carried by said movable blade bracket.

3. The paper loading system in accordance with claim 2, wherein said unlatching means comprises an actuating arm supported by said housing, said actuating arm being pivotal about said housing in order to cam said latch stud out of said detent in order to cause the latching stud, and hence, the fixed blade bracket of the fixed blade assembly, to unlatch from said movable blade assembly.

4. The paper loading system in accordance with claim 3, wherein said unlatching means further comprises means defining a camming surface disposed upon said movable blade assembly, said latch stud moving over said camming surface upon latching and unlatching of said fixed and movable blade assemblies.

5. The paper loading system in accordance with claim 4, wherein said unlatching means further comprises a pair of tension springs carried by said housing, said tension springs biasing the stud to ride over said camming surface in order to latch and reseat itself within said latching detent.

6. The paper loading system in accordance with claim 2, further comprising a cap for anchoring said pivotal bracket to said housing and a tension spring disposed between said cap and said housing and providing a spring biasing between said pivotal bracket and said cap, thus joining said pivotal bracket to said cap, said pivotal bracket being able to temporarily separate from said cap under the influence of said spring biasing.

7. A paper loading system that features convenient drop-in paper loading with a full slip path in a receipt printer, comprising:

supporting means defining a paper loading bucket;

a fixed blade assembly carried by said supporting means and having a surface supporting a slip path;

a movable blade assembly disposed adjacent to said fixed blade assembly in a first, latched position;

means defining a receipt path disposed within said supporting means;

means defining a slip path disposed within said supporting means and supported by said fixed blade assembly surface, said slip path being adjacent to said receipt path, said receipt path running between said fixed blade assembly and said movable blade assembly; and unlatching means carried by said supporting means for unlatching said fixed blade assembly from said movable blade assembly, whereby said movable blade assembly may be moved to a second, unlatched position providing access to said paper loading bucket, wherein said paper can be drop loaded into said paper loading bucket.

8. The paper loading system in accordance with claim 7, wherein said fixed blade assembly comprises a pivotal bracket having a latch stud disposed thereon, and said movable blade assembly comprises a movable blade bracket having a latching detent for receiving said latch stud, said fixed and movable blade assemblies being latched via the latch stud that drops into said latching detent carried by said movable blade bracket.

9. The paper loading system in accordance with claim 8, wherein said unlatching means comprises an actuating arm supported by said supporting means, said actuating arm being pivotal about said supporting means in order to cam said latch stud out of said detent in order to cause said latch stud, and hence, the fixed blade bracket of said fixed blade assembly to unlatch from said movable blade assembly.

10. The paper loading system in accordance with claim 9, wherein said unlatching means further comprises means defining a camming surface disposed upon said movable blade assembly, said latch stud moving over said camming surface upon latching and unlatching of said fixed and movable blade assemblies.

11. The paper loading system in accordance with claim 10, wherein said unlatching means further comprises a pair of tension springs carried by said supporting means, said tension springs biasing said latch stud to ride over said camming surface in order to latch and reseat itself within said latching detent.

12. The paper loading system in accordance with claim 8, further comprising a cap for anchoring said pivotal bracket to said supporting means, and a tension spring disposed between said cap and said supporting means, and providing a spring biasing between said pivotal bracket and said cap, thus joining said pivotal bracket to said cap, said pivotal bracket being able to temporarily separate from said cap under the influence of said spring biasing.

13. A paper loading system that features convenient drop-in paper loading with a full slip path in a receipt printer, comprising:

supporting means defining a paper loading bucket;

a fixed blade assembly carried by said supporting means and having a surface supporting a slip path;

a rotary blade assembly disposed adjacent to said fixed blade assembly in a first, latched position;

means defining a receipt path disposed within said supporting means;

means defining a slip path disposed within said supporting means and supported by said fixed blade assembly surface, said slip path being adjacent to said receipt path, said receipt path running between said fixed blade assembly and said rotary blade assembly; and unlatching means carried by said supporting means for unlatching said fixed blade assembly from said rotary blade assembly, whereby said rotary blade assembly may be moved to a second, unlatched position providing access to said paper loading bucket, wherein said paper can be drop loaded into said paper loading bucket.

14. The paper loading system in accordance with claim 13, wherein said fixed blade assembly comprises a pivotal bracket having a latch stud disposed thereon, and said rotary blade assembly comprises a movable blade bracket having a latching detent for receiving said latch stud, said fixed and rotary blade assemblies being latched via the latch stud that drops into said latching detent carried by said movable blade bracket.

15. The paper loading system in accordance with claim 14, wherein said unlatching means comprises an actuating arm supported by said supporting means, said actuating arm being pivotal about said supporting means in order to cam said latch stud out of said detent, in order to cause the latching stud, and hence, the fixed blade bracket of the fixed blade assembly to unlatch from said rotary blade assembly.

16. The paper loading system in accordance with claim 15, wherein said unlatching means further comprises means defining a camming surface disposed upon said rotary blade assembly, said latch stud moving over said camming surface upon latching and unlatching of said fixed and rotary blade assemblies.

17. The paper loading system in accordance with claim 16, wherein said unlatching means further comprises a pair of tension springs carried by said supporting means, said tension springs biasing said stud to ride over said camming surface, in order to latch and reseat itself within said latching detent.

18. The paper loading system in accordance with claim 14, further comprising a cap for anchoring said pivotal bracket to said supporting means, and a tension spring disposed between said cap and said supporting means for providing a spring biasing between said pivotal bracket and said cap, thus joining said pivotal bracket to said cap, said pivotal bracket being able to temporarily separate from said cap under the influence of said spring biasing.

* * * * *